United States Patent [19]

Looger et al.

[11] Patent Number: 4,488,488

[45] Date of Patent: Dec. 18, 1984

[54] WARHEAD SAFETY AND RIBBON CHUTE HOLDER

[75] Inventors: Lonnie L. Looger, Madison; Gerald S. Smith, Huntsville, both of Ala.

[73] Assignee: The United States of America as represented by the Secretary of the Army, Washington, D.C.

[21] Appl. No.: 452,487

[22] Filed: Dec. 23, 1982

[51] Int. Cl.[3] ..... F42B 25/02; F42B 25/22

[52] U.S. Cl. ..... 102/387; 102/396

[58] Field of Search ..... 102/386, 387, 393, 396

[56] References Cited

U.S. PATENT DOCUMENTS

| | | | |
|---|---|---|---|
| 1,330,425 | 2/1920 | Bergman | 102/387 |
| 2,377,587 | 6/1945 | Strong | 102/387 |
| 3,382,803 | 5/1968 | Swallow et al. | 102/387 |
| 3,604,352 | 9/1971 | Bench | 102/386 |
| 4,178,851 | 12/1979 | Brady | 102/393 |

*Primary Examiner*—Charles T. Jordan

*Attorney, Agent, or Firm*—Anthony T. Lane; Robert P. Gibson; Harold W. Hilton

[57] ABSTRACT

A device which serves as a safety mechanism for a warhead to prevent accidental detonation thereof. The warhead includes a chute in the form of a ribbon which is folded thereon prior to flight of the warhead to a target. The device serves to releasably secure the ribbon chute to the warhead while also acting as a safety mechanism.

4 Claims, 7 Drawing Figures

WARHEAD SAFETY AND RIBBON CHUTE HOLDER

DEDICATORY CLAUSE

The invention described herein may be manufactured, used, and licensed by or for the Government for governmental purposes without the payment to us of any royalties thereon.

BACKGROUND OF THE INVENTION

It is known that enemy strategy, in warfare using tanks, is to assemble a large number of tanks in a staging area for continuous assault on targets. To combat such large number of tanks, the U.S. Army has designed a weapon system which includes rockets which "fly over" the tanks and drop bomblets on the tanks, since the top of the tanks are more vulnerable than other sections of the tanks.

In one such system, a large number of bomblets are carried in the ogive of a rocket in serial, nested relation and when the rocket is over the staging area, an explosive is detonated to propel the bomblets through the rocket's ogive and above the large number of tanks for impact therewith.

Each bomblet contains a shaped-charge and igniter mechanism. The bomblets are also equipped with a ribbon-chute in the form of small ribbon which unfurls when the bomblets are propelled from the nose of the rocket. The chute stabilizes the bomblet in flight. The chutes are folded on the upper end of each bomblet and held in folded position by a polyethylene collar which is circumferentially carried about the upper portion of the bomblet. Since each bomblet is stowed in nested, serial relation (upper end of one bomblet inserted in the aft end of another bomblet) the collar is positioned in the hollow, aft conical end of the adjacent bomblet. This collar sometimes becomes lodged in the cone of the forward warhead when the bomblets are propelled from the nose cone of the rocket. This condition causes an unacceptable degradation of warhead penetration when the bomblet impacts with a target.

The igniter for the bomblet includes a firing pin which engages a detonator for detonating the shaped charge upon impact with the target. The detonator is mounted on a slider which moves the detonator under the firing pin to permit the firing pin to engage the detonator.

The handling safeties prior to loading the bomblet into the missile include a long soft roll-pin which is positioned through the slider and in engagement with the igniter housing. This retains the slider in its unarmed (detonator not under the firing pin) position. A second safety is a "bobby pin∞ extending transversely through the igniter housing and in locking engagement with the firing pin to restrain the firing pin from movement. Both of these safeties are removed prior to positioning the bomblets in the missile. Therefore, an additional safety mechanism must be provided to prevent the warhead from accidental detonation prior to release of the bomblets from the ogive of the rockets on the battlefield.

The device of the present invention allows both above-discussed safeties to be used and also handles the ribbon-chute storage problem to prevent warhead penetration degradation.

SUMMARY OF THE INVENTION

A safety and arming device for a warhead having a ribbon chute thereon. The device is a clip which retains the ribbon chute in folded position atop the warhead. The clip includes four legs spaced 90° apart which engage the ribbon chute. The legs are notched to permit a "boddy pin" safety device to be inserted through the housing of the warhead igniter. The same leg is provided with a downwardly extending offset portion which engages a slider having a detonating charge thereon and prevents the slider from moving to an armed position e.g., prevents the detonating charge carried by the slider from moving under a firing pin of the igniter. A hole is provided in the leg to permit a second safety device, a pin, to be inserted therethrough and in locking engagement with the igniter housing.

DESCRIPTION OF THE PREFERRED EMBODIMENT

Figure 1:
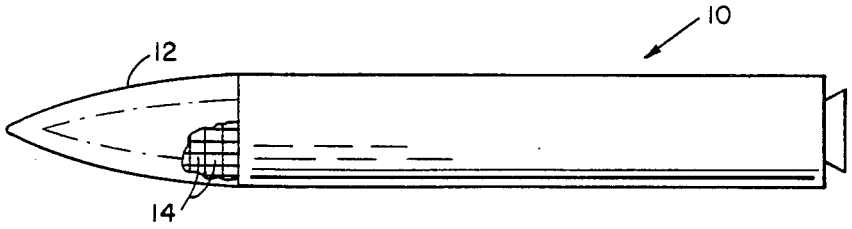
FIG. 1 is an elevational view partially in section of a missile having a plurality of warheads stowed in the nose cone in nested relation.
Figure 2:
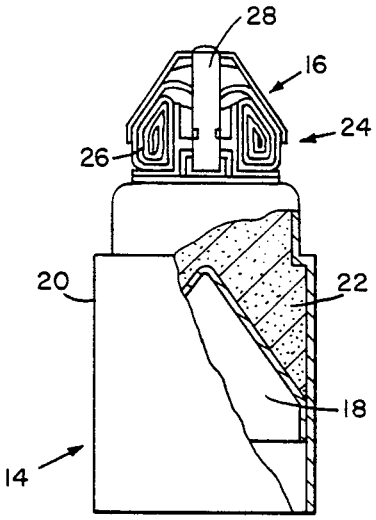
FIG. 2 is an elevational view of the warhead having a ribbon chute thereon in folded position and the clip of the present invention disposed thereon.
Figure 3:
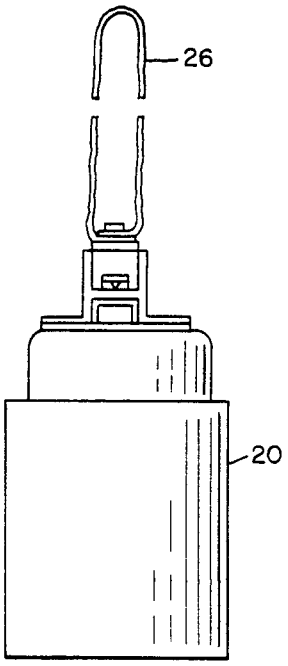
FIG. 3 is an elevational view of the present invention illustrating the warhead in free flight with the ribbon chute unfurled.

As seen in FIG. 1, a rocket 10 includes an ogival nose cone 12 having a plurality of bomblets 14 stowed therein. The bomblets are positioned in nested relation. That is, the forward end 16 (FIG. 2) of one is positioned in a conical aft end 18 of another warhead, in serial relation. The warhead includes a body 20 enclosing a shaped charge 22. An igniter assembly 24 is secured to end 16 of the body 20. Secured to the igniter assembly 24 is a chute 26. Chute 26 is a ribbon and is shown in FIG. 2 is folded position. A clip 28 retains the chute in folded position. FIG. 3 illustrates the chute 26 in the unfurled position.

Figure 4:
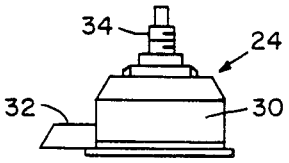
FIG. 4 is an elevational view of the igniter assembly for igniting the warhead.
Figure 5:
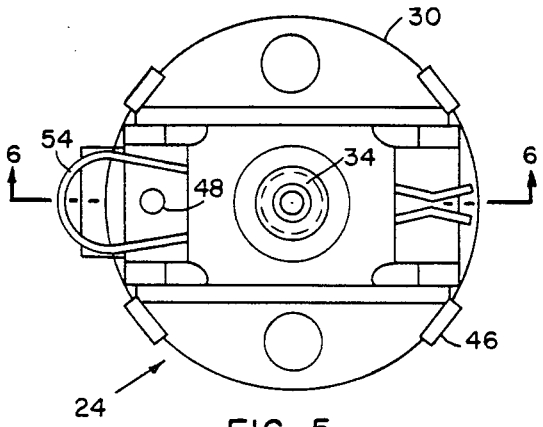
FIG. 5 is a top elevational view of the igniter assembly of FIG. 4.

Igniter assembly 24 (FIGS. 4, 5, and 6) includes an igniter body 30 housing a slider member 32 and a firing pin 34 which is mounted in a slidable support member 35 (FIG. 6) mounted in housing 30. An igniter charge 36 is disposed in slider 32. A spring 38 is carried in an opening 40 of slider 32. One end of spring 38 abuts against an upstanding member 42 of a base plate 44 which is secured to body 30 by tabs 46 (FIG. 5). The other end of spring 38 abuts against a shoulder of opening 40.

Figure 6:
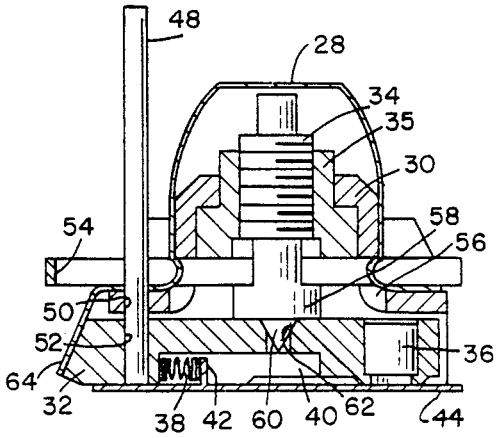
FIG. 6 is a sectional view taken along line 6—6 of FIG. 5.
Figure 7:
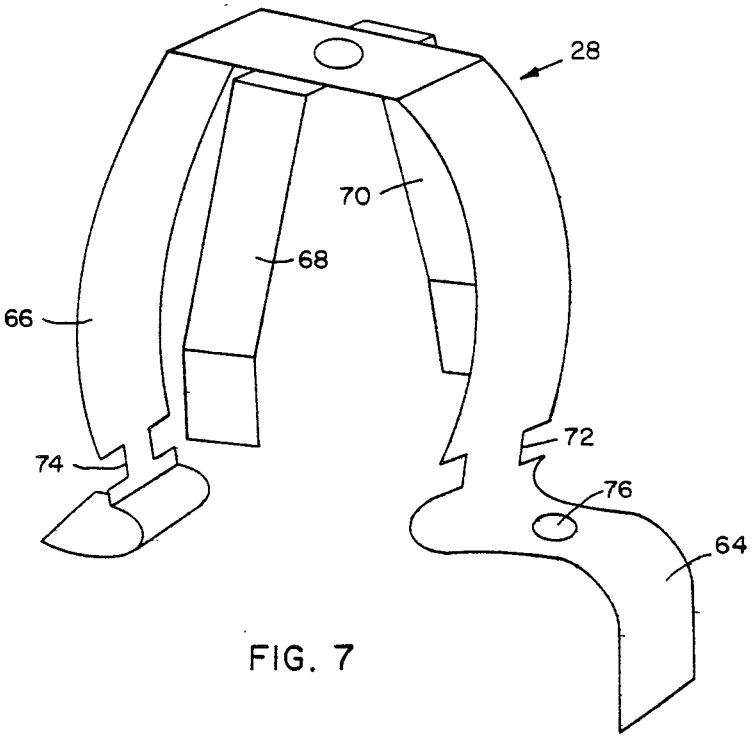
FIG. 7 is a pictorial view of the safety and ribbon chute holder of the present invention.

Three safeties restrain the slider in the unarmed position. That is, the detonating charge in the slider is displaced from contact with the firing pin. The first safety is a roll pin 48 which extends through an opening 50 in housing 30 and into an opening 52 of slider 32. The second safety is a "bobby pin" member 54 which extends through an opening 56 in housing 30 and in engagement with a shoulder 58 of firing pin 34 to retain the tip 60 of firing pin 34 in an opening 62 of slider 32. The third safety is clip 28 which includes four legs 64, 66, 68 and 70 (FIG. 7). As seen in FIG. 6, leg 64 is in engagement with slider 32.

FIG. 2 illustrates clip 28 in position on the igniter to retain the ribbon 26 in the folded position on the bomblet. In FIG. 6 the ribbon has not been shown for clarity. As seen in FIG. 7, legs 64 and 66 include cutaway portions 72 and 74, respectively. These cutaway portions permit the legs of "bobby pin" 54 to engage clip 28 for secured relation thereof to the body of the igniter. Legs 68 and 70 are disposed for engagement with ribbon 26 for retention thereof in folded relation. Leg 64 of clip 28 includes an opening 76 therethrough to permit roll pin 48 to be inserted into slider 32, as seen in FIG. 6.

When the bomblets are to be placed in nose 12 of rocket 10, roll pin member 48 and bobby pin member 54 are removed, this leaves only leg 64 of the clip in position to retain member 32 from movement. At the target area, an explosive charge (which extends longitudinally through the nose 12, along the longitudinal axes of the missile) is ignited in the ogive of rocket 10 to propel the bomblets out of the rocket by shearing the nose section 12 along scored lines on the nose section. The force of ejection of the bomblets removes clip 28 from the assembly and chutes 26 unfurl to stabilize the bomblets. The chutes also set up vibrations on the bomblets and these vibrations, coupled with drag friction on the chute, move firing pin 34 away from slider 32. This is because the pin 34 is loosely threaded in member 35 which is loosely mounted in the igniter housing. Responsive to tip 60 of firing pin 34 being removed from hole 62 of slider 32, the spring 38 biases the slider outwardly so that the shoulder of opening 40 engages upstanding member 38. By this movement, detonater 36 is positioned directly under the firing pin. Impact with the target moves pin support member 35 and pin 34 downward so that the tip 60 engages detonator 36 for detonation thereof.

We claim:

1. In a warhead disposed for impact with a target, said warhead including an igniter for detonation thereof and a chute for stabilizing said warhead in flight to said target, a device for releasably retaining said chute on said warhead and for cooperating with said igniter to prevent accidental detonation thereof prior to impact with said target, said device being a clip member having four legs spaced 90° apart for straddling said chute for retention thereof in a folded relation on said igniter.

2. A device as in claim 1 wherein said igniter includes a slider having detonation means thereon, means for biasing said slider to an armed position and a firing pin for engagement with said detonation means, a first leg of said four legs having a portion thereof disposed for engagement with said slider to prevent movement thereof prior to flight of said warhead to prevent accidental detonation thereof.

3. A device as in claim 2 wherein said igniter includes a housing having an opening therethrough and a pin disposed for engagement with said slider to prevent movement thereof, said first leg of said four legs of said clip member having an opening through which said pin is inserted for the engagement thereof with said slider.

4. A device as in claim 3 wherein said igniter includes a bobby pin member extending transversely through said housing for engagement with said firing pin to prevent movement thereof, said first leg and a second oppositely disposed leg of said clip provided with cutaway portions on each side thereof, whereby said bobby pin engages said cutaway portions for retention of said clip on said igniter.

* * * * *